United States Patent [19]

Fralish

[11] 4,255,881

[45] Mar. 17, 1981

[54] ADJUSTMENT MECHANISM FOR CHUTE DEFLECTOR

[75] Inventor: Mark R. Fralish, Berlin, Wis.

[73] Assignee: J. I. Case Company

[21] Appl. No.: 99,066

[22] Filed: Nov. 30, 1979

[51] Int. Cl.[3] ..... E01H 5/00

[52] U.S. Cl. ..... 37/43 R; 74/534; 74/527

[58] Field of Search ..... 37/43 R, 43 A–43 L, 37/53; 74/527, 529, 532–536, 540, 541, 475, 144, 156, 160, 162, 169, 111

[56] References Cited

U.S. PATENT DOCUMENTS

| | | | |
|---|---|---|---|
| 107,956 | 10/1870 | Peoble | 74/534 |
| 824,006 | 6/1906 | Glennon | 74/535 |
| 1,391,948 | 9/1921 | Gledhill | 74/533 |
| 3,109,320 | 11/1963 | Krautwurst | 74/535 X |
| 3,287,991 | 11/1966 | Eckert | 74/533 |
| 3,510,171 | 5/1970 | Bacon | 37/43 R X |
| 3,552,045 | 1/1971 | Fieber | 37/43 R |
| 3,975,972 | 8/1976 | Muhleck | 74/529 |
| 4,068,397 | 1/1978 | Bacon | 37/43 R |

*Primary Examiner*—E. H. Eickholt
*Attorney, Agent, or Firm*—Cullen, Sloman, Cantor, Grauer, Scott & Rutherford

[57] ABSTRACT

An adjustment mechanism for snow deflectors is disclosed which is connected between a discharge chute and pivotal deflector to permit an operator to orient and secure the deflector at a desired angular position without leaving his station. The angular adjustment of the deflector is controlled by the operator pulling on a flexible cable which is connected at one end to the deflector. The adjustment mechanism includes a ratchet block which is pivotally secured at one of its ends to the chute and a shouldered pin which is fixed to the deflector. The shouldered pin extends into the ratchet block for locking engagement therewith. The deflector and ratchet block pivot in response to the operator pulling the flexible cable which permits the shouldered pin to engage a selected one of several locking teeth along a toothed slot in the ratchet block thereby securing the deflector at various selected angular deflecting positions. The shouldered pin and attached deflector are selectively movable along the toothed slot until the maximum angular deflecting position of the deflector is reached, at which point the ratchet block may be automatically disengaged from the shouldered pin and the deflector returned to its minimum angular deflecting position by a coil spring connected between the chute and deflector.

4 Claims, 7 Drawing Figures

FIG. 3
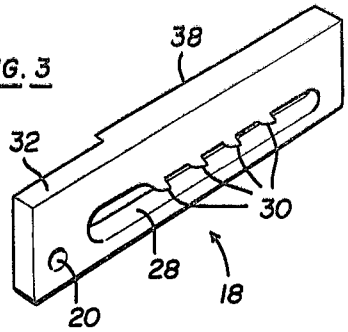
FIG. 2
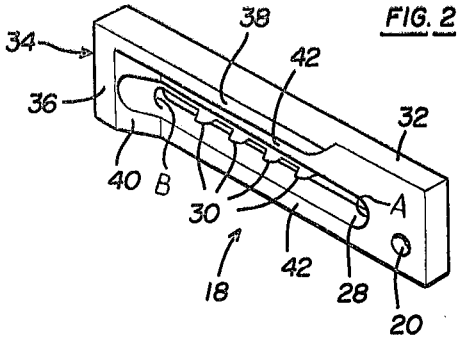
FIG. 1
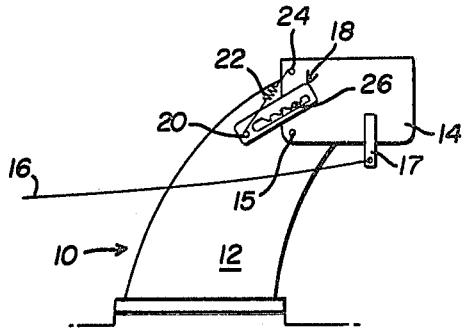
FIG. 5
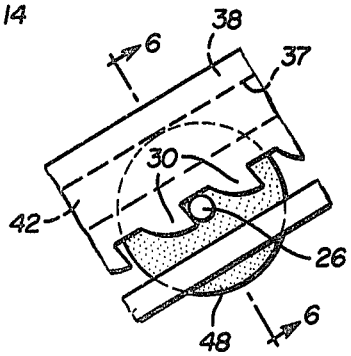
FIG. 4
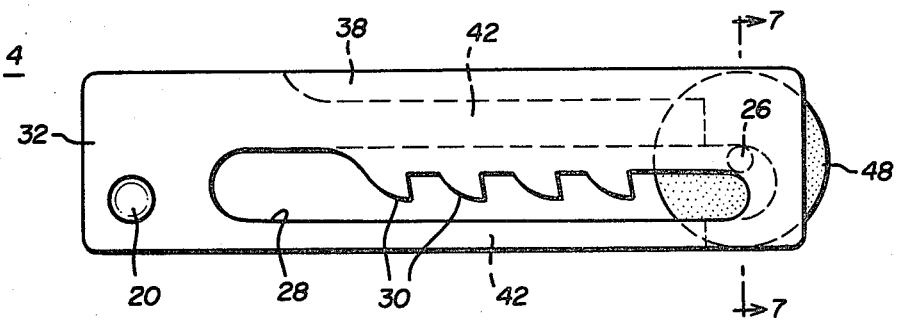
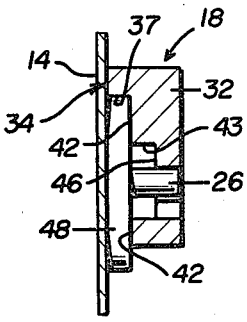
FIG. 6
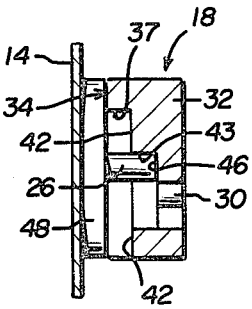
FIG. 7

ADJUSTMENT MECHANISM FOR CHUTE DEFLECTOR

BACKGROUND OF THE INVENTION

The present invention relates to a means for adjusting the pivotal deflector on an exhaust chute of a snow thrower machine, and more particularly, to an adjustment mechanism which is connected between the chute and deflector that permits an operator to angularly orient and secure the deflector on the exhaust end of the chute from the operator's seat or location.

It is conventional to provide a snow thrower machine having an exhaust chute for expelling snow and a deflector pivotally mounted at the exhaust end of the chute to direct the discharged snow outwardly in a desired path. The deflector is pivotally attached to the exhaust end of the chute for swinging movement to vary the direction of discharge of the snow. Typically, the deflector is manually adjusted by the operator and secured at a desired angular position.

A problem with known snow deflector arrangements is that the operator must constantly leave the operator's station or location to adjust the deflector for varying the direction of snow discharged. This is an inconvenience that detracts from the normal running operation of the machine. Thus, there has been a need for a mechanism that permits an operator to adjust and secure the deflector from the operator's location.

The disadvantages of present snow deflector arrangements have resulted in the adjustment mechanism of the present invention which permits an operator to selectively pivot and secure the deflector on the exhaust end of the chute at a desired angular position without leaving the operator's station.

SUMMARY OF THE INVENTION

In accordance with the present invention, a deflector is pivotally mounted to the exhaust end of a chute or funnel for a snow thrower machine to direct the discharged snow outwardly in a desired angular path. The deflector is swingable along an arc between minimum and maximum angular deflecting positions, and it is biased towards its minimum angular deflecting position by a coil spring connected between the chute and deflector. The angular adjustment of the deflector is controlled by the operator pulling on a flexible cable which is connected at one end to the deflector. The adjustment mechanism of the present invention is connected between the chute and deflector which permits the operator to orient and secure the deflector at a desired angular position along the arc without leaving his station.

The adjustment mechanism includes a ratchet block which is pivotally secured at one of its ends to the chute and a shouldered pin which is fixed to the deflector. The shouldered pin extends into the ratchet block for locking engagement therewith. The deflector and ratchet block pivot in response to the operator pulling the flexible cable which permits the shouldered pin to engage a selected one of several locking teeth along a toothed slot in the ratchet block thereby securing the deflector at various selected angular deflecting positions.

The shouldered pin and attached deflector are selectively movable along the toothed slot until the maximum angular deflecting position of the deflector is reached, at which point the ratchet block may be automatically disengaged from the shouldered pin and the deflector returned to its minimum angular deflecting position by the coil spring connected between the chute and deflector. Thus, the operator may easily orient the deflector to change the angle of snow discharged by successively pulling the flexible cable until the maximum angular deflecting position is reached and then the deflector may be automatically returned to its minimum angular deflecting position without the operator leaving his station.

The ratchet block includes a rectangularly shaped main body portion having an elongated toothed slot and a L-shaped return track which is upstanding from the main body portion. The long leg of the return track extends along one of the longitudinal edges of the main body and the short leg extends along the edge of one of the transverse ends of the main body. The outer surface of the return track is connected to the outer surface of the main body portion by a ramp surface formed at one end of the main body portion in the notch formed by the L-shaped return track.

The ratchet block is pivotally connected at one of its ends to the chute by a pin and its other end is unattached. The pin connection is flexible permitting the unattached end of the ratchet block to be pushed away from the shouldered pin when it is desired to return the deflector to its minimum angular deflecting position, as will be described.

In operation, the shouldered pin is selectively movable along the toothed slot, in response to the operator's pulling on the flexible cable, from one end of the slot where the deflector is at its minimum angular deflecting position to the opposite end of the toothed slot where the deflector is at its maximum angular deflecting position. The shoulder of the pin bears against the up-standing side of the long leg of the return track as the pin is selectively moved along the toothed slot. At the opposite end of the slot, the ramp surface causes the pin to become disengaged from the toothed slot as the shoulder portion of the pin moves onto the return track which pushes the ratchet block outwardly relative to the surface of the deflector thereby disengaging the pin from the toothed slot. The coil spring attached between the chute and deflector causes the shoulder of the pin and attached deflector to slide to the opposite end of the ratchet block along the return track where the pin automatically falls off the return track and back into the toothed slot without the operator ever leaving his station.

Other advantages and meritorious features of the adjustment mechanism of the present invention will be more fully understood from the following description of the preferred embodiment, the appended claims, and the drawings, a brief description of which follows.

BRIEF DESCRIPTION OF DRAWINGS

FIG. 1 is a partial side elevational view of a snow thrower machine embodying the adjustment mechanism of the present invention for angularly orienting and securing the pivotal deflector on the exhaust end of the discharge chute.

FIG. 2 is a perspective view of the ratchet block illustrating the side of the block that is closest to the deflector when mounted.

FIG. 3 is a perspective view of the ratchet block illustrating the side opposite that shown in FIG. 2.

FIG. 4 is a side elevational view of the ratchet block in its mounted position illustrating the shouldered pin's movement onto the return track.

FIG. 5 is a partial side elevational view illustrating the engagement of the shouldered pin with the toothed slot of the ratchet block.

FIG. 6 is a cross-sectional view taken along line 6—6 of FIG. 5 illustrating the shouldered pin in its engaged position with the toothed slot.

FIG. 7 is a cross-sectional view taken along line 7—7 in FIG. 4 illustrating the shouldered pin on the return track of the ratchet block.

DESCRIPTION OF THE PREFERRED EMBODIMENT

A preferred embodiment of the adjustment mechanism made in accordance with the teachings of the present invention as illustrated in FIGS. 1–7.

The present invention relates to a means for adjusting the pivotal deflector on an exhaust chute of a snow thrower machine. A conventional snow thrower machine 10 is partially illustrated in FIG. 1, and it includes powered blades (not shown) which create an air blast for discharging snow through chute or funnel 12. A deflector 14 is pivotally mounted by pivot pin 15 to the exhaust end of chute 12 to direct the discharged snow outwardly in a desired path. The angular adjustment of the deflector 14 is controlled by the operator pulling on a flexible cable 16 which is connected at one end to the deflector 14 by link 17.

The adjustment mechanism of the present invention is connected between the chute 12 and deflector 14 which permits the operator to orient and secure the deflector at a desired angular position without leaving his station. The adjustment mechanism includes a ratchet block 18 which is pivotally secured by flexible spring pin 20 at one of its ends to the chute 12. Deflector 14 is swingable along an arc between minimum and maximum angular deflecting positions, and it is biased towards its minimum angular deflecting position by coil spring 22 which is connected between pin 20 on chute 12 and pin 24 on deflector 14.

Referring to FIGS. 1 and 4–6, the adjustment mechanism also includes a shouldered pin 26 which is fixed to deflector 14. Shouldered pin 26 extends into the ratchet block 18 for locking engagement therewith. Deflector 14 and ratchet block 18 are pivotal in response to the operator pulling the flexible cable 16 which permits the shouldered pin 26 to engage one of several locking teeth 30 along toothed slot 28 in the ratchet block 18 thereby selectively securing the deflector 14 at various angular deflecting positions.

Shouldered pin 26 and attached deflector 14 are selectively movable along toothed slot 28 from the minimum deflecting position (position "A", FIG. 2) to the maximum angular deflecting position of deflector 14 (position "B", FIG. 2) at which point the ratchet block 18 may be disengaged from the shouldered pin 26 and deflector 14 returned to its minimum angular deflecting position in response to the tension in coil spring 22 connected between chute 12 and deflector 14. Thus, the operator may easily orient the deflector to change the angle of snow discharge by successively pulling the flexible cable 16 until the maximum angular deflecting position is reached, and then further pulling on cable 16 causes deflector 14 to be automatically returned to its minimum angular deflecting position without the operator leaving his station.

Referring to FIGS. 2–7, ratchet block 18 includes a rectangularly shaped main body portion 32 having an elongated slot 28 with a plurality of teeth 30. Ratchet block 18 further includes a L-shaped return track 34 which is upstanding from the main body portion 32. The long leg 38 of the return track extends along one of the longitudinal edges of the main body portion, and the short leg 36 extends along the edge of one of the transverse ends of the main body. The outer surface of the return track 34 is connected to the outer surface 42 of the main body portion 32 by a ramp surface 40 formed at one end of the main body portion in the notch formed by the L-shaped return track 34 as illustrated in FIG. 2. It should be noted that the side of ratchet block 18 illustrated in FIG. 2 faces inwardly toward deflector 14 when ratchet block 18 is mounted.

Ratchet block 18 is pivotally connected at one of its ends to the chute 12 by a pin 20 and its other end is unattached. Pin 20 is flexible permitting the unattached end of ratchet block 18 to be pushed away from shouldered pin 26 when it is desired to return the deflector 14 to its minimum angular deflecting position, as will be described.

In operation, shouldered pin 26 and attached deflector 14 are selectively movable along toothed slot 28, in response to the operator's pulling on cable 16, from one end of the slot (position "A", FIG. 2) where the deflector 14 is at its minimum angular deflecting position to the opposite end of the toothed slot (position "B", FIG. 2) where the deflector is at its maximum angular deflecting position. As illustrated in FIGS. 5 and 6, the shoulder 48 of pin 26 bears against up-standing side wall 37 of long leg 38 as pin 26 is selectively moved along toothed slot 28 into engagement with one of the teeth 30. At the opposite end of slot 28 (FIGS. 4 and 7), ramp surface 40 causes pin 26 to become disengaged from teeth 30 in slot 28 as the shoulder portion 48 of pin 26 moves onto return track 34, which pushes ratchet block 18 outwardly relative to the surface of deflector 14 thereby disengaging pin 26 from toothed slot 28. At this point, as best illustrated in FIG. 7, pin 26 bears against surfaces 43 and 46 of slot 28. Coil spring 22 causes shoulder portion 48 and attached deflector 14 to slide to the opposite end of ratchet block 18 along return track 34 where pin 26 falls off the return track and back into toothed slot 28 without the operator ever leaving his station.

Thus, each time the operator pulls flexible cable 16, deflector 14 and ratchet block 18 pivot, thereby forcing pin 26 to progressively move along teeth 30 to the desired adjustment point. At the maximum angular deflecting position, as illustrated in FIG. 1, further pulling on flexible cable 16 causes shoulder 48 of pin 26 to move onto return track 34 thereby permitting deflector 14 to swing, automatically, back to its minimum deflecting position and also permitting pin 26 to fall back into toothed slot 28 so that the adjustment process can begin again.

It will be apparent to those skilled in the art that the foregoing disclosure is exemplary in nature rather than limiting, the invention being limited only by the appended claims.

I claim:

1. In a snow thrower machine having an xhaust chute for expelling snow and a deflector pivotally mounted at the exhaust end of the chute to direct the discharged snow outwardly in a desired path, a flexible cable being connected at one of its ends to the deflector, the improvement comprising:

an adjustment mechanism connected between the chute and pivotal deflector, said adjustment mechanism including a ratchet block and a pin, said ratchet block being pivotally secured at one of its ends to said chute and said pin being fixed to said deflector;

said ratchet block having a slot and a plurality of locking teeth along said slot, said pin extending into said slot for selective locking engagement with one of said plurality of teeth;

said deflector being swingable along an arc between minimum and maximum angular deflecting positions and said deflector being biased towards said minimum angular deflecting position by tension spring means connected between said chute and said deflector; and said deflector and said ratchet block being pivotal in response to pulling on said flexible cable thereby permitting said pin to engage a selected one of said plurality of locking teeth along said slot to secure said deflector at a selected angular deflecting position.

2. The snow thrower machine as defined in claim 1 wherein said ratchet block includes a main body surface portion and a return track surface portion, said return track surface portion being spaced apart from said main body surface portion, said main body surface portion being connected to said return track surface portion by an inclined surface portion;

said pin including a shoulder portion, said pin being movable from one end of said toothed slot where the deflector is at its minimum angular deflecting to the opposite end of said toothed slot where the deflector is at its maximum angular deflecting position;

said ratchet block being connected at one of its ends to said chute by flexible connecting means and its other end being unattached;

said shoulder portion of said pin being engageable with said main body surface portion as said pin is selectively moved along said toothed slot, and said shoulder portion being movable along said inclined surface portion and on to said return track surface portion at the end of said toothed slot where the deflector is at its maximum angular deflecting position whereby said ratchet block is pushed outwardly relative to said deflector as said shoulder portion moves on to said return track surface and said pin becoming disengaged from said toothed slot, thereby permitting said deflector to return to its minimum angular deflecting position in response to tension in said spring means.

3. A ratchet block including a rectangularly shaped main body portion, said ratchet block having longitudinal edge portions and transverse end portions, said main body portion having opposed sides, said main body portion including an elongated slot and a plurality of teeth along said slot, a L-shaped track portion upstanding from said main body portion, said track portion including an outer surface, said track portion having a long leg portion and a short leg portion, said long leg portion extending along one of the longitudinal edge portions of the main body and the short leg portion extending along one of the transverse end portions of the main body, said outer surface of said track portion being connected to one of the sides of said main body portion by an inclined surface, said inclined surface being at one end of said main body portion in the notch formed by the L-shaped track portion.

4. The ratchet block as defined in claim 3 wherein the ratchet block in cross-section consists of a plurality of steps formed by said elongated slot, said main body portion, and said track portion.

* * * * *